US009941106B2

(12) United States Patent
Wildgoose

(10) Patent No.: US 9,941,106 B2
(45) Date of Patent: Apr. 10, 2018

(54) QUADRUPOLE ROBUSTNESS

(71) Applicant: Micromass UK Limited, Wilmslow (GB)

(72) Inventor: Jason Lee Wildgoose, Stockport (GB)

(73) Assignee: MICROMASS UK LIMITED, Wilmslow (GB)

( * ) Notice: Subject to any disclaimer, the term of this patent is extended or adjusted under 35 U.S.C. 154(b) by 0 days.

(21) Appl. No.: 15/316,569

(22) PCT Filed: Jun. 10, 2015

(86) PCT No.: PCT/GB2015/051702
§ 371 (c)(1),
(2) Date: Dec. 6, 2016

(87) PCT Pub. No.: WO2015/189611
PCT Pub. Date: Dec. 17, 2015

(65) Prior Publication Data

US 2017/0162374 A1 Jun. 8, 2017

(30) Foreign Application Priority Data

Jun. 11, 2014 (EP) ..... 14171992
Jun. 11, 2014 (GB) ..... 1410395.6

(51) Int. Cl.
*H01J 49/06* (2006.01)
*H01J 49/42* (2006.01)

(52) U.S. Cl.
CPC ..... *H01J 49/061* (2013.01); *H01J 49/4215* (2013.01)

(58) Field of Classification Search
CPC .... G01N 27/624; G01N 27/622; G01N 30/72; H01J 49/0031; H01J 49/004; H01J 49/06;
(Continued)

(56) References Cited

U.S. PATENT DOCUMENTS 5,572,022 A 11/1996 Schwartz et al.
6,982,415 B2 1/2006 Kovtoun
(Continued)

FOREIGN PATENT DOCUMENTS

GB 2443952 5/2008
GB 2493074 1/2013

*Primary Examiner* — David A Vanore
(74) *Attorney, Agent, or Firm* — Womble Bond Dickinson (US) LLP; Deborah M. Vernon; Heath T. Misley

(57) ABSTRACT

An apparatus for filtering ions is disclosed comprising a separation device for separating ions temporally according to a first physico-chemical property and a first quadrupole rod set for filtering ions according to their mass to charge ratio, wherein the first quadrupole rod set comprises a plurality of rods and wherein the first quadrupole rod set is arranged downstream of the separation device. The apparatus further comprises a control system arranged and adapted during a single cycle of separation of the separation device: (i) to operate the first quadrupole rod set in a first resolving mode of operation wherein ions of interest are selected by the first quadrupole rod set; and (ii) to operate the first quadrupole rod set in a second non-resolving or transmission mode of operation at separation times when substantially no ions of interest are present so that substantially no ions impact upon the rods of the first quadrupole rod set.

18 Claims, 4 Drawing Sheets

(58) Field of Classification Search
CPC ..... H01J 49/061; H01J 49/40; H01J 49/421; H01J 49/4215; H01J 49/427
USPC ..... 250/281, 282, 288
See application file for complete search history.

(56) References Cited

U.S. PATENT DOCUMENTS

| | | | | |
|---|---|---|---|---|
| 7,453,061 | B2 | 11/2008 | Park et al. | |
| 8,207,495 | B2 | 6/2012 | Mukaibatake et al. | |
| 8,212,208 | B2 | 7/2012 | Green et al. | |
| 8,350,212 | B2 * | 1/2013 | Covey | H01J 49/06 250/281 |
| 8,610,054 | B2 * | 12/2013 | Giles | G01N 27/624 250/281 |
| 8,866,077 | B2 | 10/2014 | Okumura et al. | |
| 9,318,310 | B2 * | 4/2016 | Guna | H01J 49/004 |
| 9,576,777 | B2 * | 2/2017 | Giles | H01J 49/004 |
| 9,646,813 | B2 * | 5/2017 | Bateman | G01N 27/622 |
| 9,799,499 | B2 * | 10/2017 | Kobayashi | H01J 49/005 |
| 2010/0108878 | A1 * | 5/2010 | Bateman | G01N 27/622 250/283 |
| 2010/0108879 | A1 * | 5/2010 | Bateman | G01N 27/622 250/283 |
| 2014/0284469 | A1 * | 9/2014 | Langridge | H01J 49/063 250/282 |
| 2015/0041636 | A1 * | 2/2015 | Giles | H01J 49/004 250/282 |
| 2016/0202219 | A1 * | 7/2016 | Sakamoto | G01N 30/8679 702/23 |
| 2017/0162374 | A1 * | 6/2017 | Wildgoose | H01J 49/061 |
| 2017/0199153 | A1 * | 7/2017 | Moulds | G01N 27/622 |

* cited by examiner

QUADRUPOLE ROBUSTNESS

CROSS-REFERENCE TO RELATED APPLICATIONS

This application represents the U.S. National Phase of International Application number PCT/GB2015/051702 entitled "Improved Quadrupole Robustness" filed 10 Jun. 2015, which claims priority from and the benefit of United Kingdom patent application No. 1410395.6 filed on 11 Jun. 2014 and European patent application No. 14171992.2 filed on 11 Jun. 2014. The entire contents of these applications are incorporated herein by reference.

FIELD OF THE INVENTION

The present invention relates generally to mass spectrometry and in particular to apparatus for filtering ions and to quadrupole rod set mass filters.

BACKGROUND

Quadrupole rod set mass filters are well known and comprise four rod electrodes. FIG. 1 shows a typical arrangement of a quadrupole rod set mass filter. An analytical quadrupole 1 is preceded by a pre-filter quadrupole 2 and followed by a post-filter quadrupole 3. In operation, an RF voltage and a resolving DC voltage are simultaneously applied to the rod electrodes of the analytical quadrupole 1 so that the quadrupole rod set operates in a mass or mass to charge ratio resolving mode of operation.

As will be well understood by those skilled in the art, when the quadrupole rod set is operated in a mass resolving mode of operation, ions having mass to charge ratios within a desired mass to charge ratio range will be onwardly transmitted by the mass filter, but undesired ions having mass to charge ratio values outside of the mass to charge ratio range will be substantially attenuated.

Ions which are not desired to be onwardly transmitted by the mass filter are attenuated by causing the ions to assume unstable trajectories in the analytical quadrupole 1. As a result, at least some of the ions will impact upon the rod electrodes of the analytical quadrupole 1.

With increasingly bright ion sources, instrument robustness due to ion beam related contamination is becoming a serious problem. This is particularly true for quadrupole based instruments wherein ions across the majority of the mass to charge ratio range entering the mass filter will be lost to the analytical quadrupole rods during ion isolation. The ions lost to the analytical quadrupole rods build up and can eventually form non-conductive layers upon the rods forming the quadrupole rod set. The non-conductive layers which may form upon the rods can alter the fields within the quadrupole rod set thereby can effect analytical performance.

FIG. 2 of GB-2443952 (Micromass) discloses an arrangement wherein a mass spectrometer comprising an ion mobility spectrometer 8 and a mass filter 4 is provided. Ions emerging from the ion mobility spectrometer 8 are selectively transmitted or discarded using an ion gate 9.

U.S. Pat. No. 5,572,022 (Schwartz) discloses a mass spectrometer comprising a quadrupole filter.

WO 2004/06853 (Horning) discloses a mass spectrometer comprising a quadrupole ion accumulator.

It is desired to provide an improved apparatus for filtering ions and an improved method of filtering ions.

SUMMARY

According to an aspect there is provided an apparatus for filtering ions comprising:

a separation device for separating ions temporally according to a first physico-chemical property;

a first quadrupole rod set for filtering the ions according to their mass to charge ratio, wherein the first quadrupole rod set comprises a plurality of rods and wherein the first quadrupole rod set is arranged downstream of the separation device; and a control system arranged and adapted during a single cycle of separation of the separation device:

(i) to operate the first quadrupole rod set in a first substantially resolving mode of operation at separation times when ions of interest are expected to emerge from the separation device so that the ions of interest are selected by or filtered according to their mass to charge ratio by the first quadrupole rod set; and (ii) to operate the first quadrupole rod set in a second substantially non-resolving or transmission mode of operation at separation times when substantially no ions of interest are expected to emerge from the separation device so that substantially no ions impact upon the rods of the first quadrupole rod set.

According to an aspect there is provided an apparatus for filtering ions comprising:

a separation device for separating ions temporally according to a first physico-chemical property;

a filtering device for filtering ions according to their mass to charge ratio, wherein the filtering device is arranged downstream of the separation device and wherein the filtering device comprises an analytical quadrupole rod set and a pre-filter quadrupole rod set arranged upstream of the analytical quadrupole rod set; and a control system arranged and adapted during a single cycle of separation of the separation device:

(i) to operate the filtering device in a first mode of operation wherein the pre-filter quadrupole rod set is operated in a transmissive mode of operation and wherein ions of interest are selected by the analytical quadrupole rod set; and (ii) to operate the filtering device in a second mode of operation at separation times when substantially no ions of interest are present wherein the pre-filter quadrupole rod set is operated in a non-transmissive mode of operation so that substantially no ions impact upon the rods of the analytical quadrupole rod set.

According to an embodiment there is provided a separation device that separates ions temporally according to a first physico-chemical property (e.g. mass to charge ratio or ion mobility). The separation device may be arranged upstream of a filtering device. The filtering device may comprise at least a first quadrupole rod set which may comprise an analytical quadrupole rod set.

In an embodiment, in each cycle of separation of the separation device, a packet of ions is pulsed into the separation device and is separated temporally according to the first physico-chemical property. The filtering device may be operated in at least two modes of operation during the cycle of separation of the separation device.

At separation times when ions of interest are present in the filtering device, the filtering device may be operated in a first mode of operation so that ions of interest are mass selected by the first quadrupole rod set i.e. the first quadrupole rod set may be operated in a resolving mode of operation in order to preferentially transmit ions having a desired mass to charge ratio.

In this first mode of operation, the first quadrupole rod set may be operated with a (relatively narrow) mass to charge ratio transmission window centred at the mass to charge ratio value of the ions of interest such that ions having mass to charge ratio values within the window are transmitted by the first quadrupole rod set.

As will be appreciated, in this first mode of operation, ions other than the ions of interest (i.e. ions having mass to charge ratio values outside the mass to charge ratio transmission window) will be attenuated such that at least some of these ions impact upon the rods of the first quadrupole rod set.

At separation times when no ions of interest are present in the filtering device, the filtering device may be operated in a second mode of operation wherein no ions impact upon the rods of the first quadrupole rod set.

The first quadrupole rod set may be operated in the second mode of operation in a non-resolving or transmissive mode of operation such that all ions received by the quadrupole rod set are onwardly transmitted. As will be appreciated, by operating the quadrupole rod set so as to onwardly transmit all ions, no ions will then impact upon the rods of the quadrupole rod set.

Thus, it will be appreciated that in the second mode of operation, when no ions of interest are present, no ions will impact upon the rods of the quadrupole rod set.

According to an alternative embodiment the same result may be achieved by filtering ions upstream of the first quadrupole rod set. According to an embodiment, the pre-filter quadrupole of a quadrupole mass filter arrangement may be operated in a non-transmissive mode of operation at separation times when substantially no ions of interest are present. As will be appreciated, by preventing ions from reaching the first quadrupole rod set, no ions will impact upon the rods of the analytical quadrupole rod set. Furthermore, using the pre-filter quadrupole of a quadrupole mass filter arrangement is a particularly simple and efficient mechanism for preventing ions from reaching the first quadrupole rod set since, for example, it does not require any additional hardware elements such as a separate upstream filter or gate.

It will be appreciated that a particularly advantageous aspect of the various embodiments is that the amount of ions that will build up upon the rods of the first quadrupole rod set will be minimised compared to conventional arrangements. Accordingly, the accuracy of the quadrupole rod set according to various embodiments is increased and the lifetime and robustness of the quadrupole rod set is advantageously extended.

FIG. 2 of GB-2443952 (Micromass) discloses an arrangement wherein a mass spectrometer comprising an ion mobility spectrometer 8 and a mass filter 4 is provided. Ions emerging from the ion mobility spectrometer 8 are selectively transmitted or discarded using an ion gate 9. GB-2443952 (Micromass) does not disclose an arrangement in which during a single cycle of separation of an ion mobility spectrometer a quadrupole rod set is operated in a non-resolving or transmission mode of operation at separation times when substantially no ions of interest are present in order to prevent ions from impacting upon the rods of the quadrupole rod set.

Similarly, GB-2443952 (Micromass) does not disclose an arrangement in which during a single cycle of separation of an ion mobility spectrometer a pre-filter quadrupole of a quadrupole mass filter arrangement is operated in a non-transmissive mode of operation at separation times when substantially no ions of interest are present in order to prevent ions from impacting upon the rods of the analytical quadrupole rod set.

It will therefore be appreciated that the various embodiments provide an improved apparatus for filtering ions and an improved method of filtering ions.

In an embodiment, the control system is arranged and adapted in the first mode of operation to operate the analytical quadrupole rod set with a first mass to charge ratio transmission window, and to operate the pre-filter quadrupole rod set with a second mass to charge ratio transmission window, wherein the second mass to charge ratio transmission window is greater than or equal to and encompasses the first mass to charge ratio transmission window.

In an embodiment, the filtering device comprises a post-filter quadrupole rod set arranged downstream of the analytical quadrupole rod set.

In an embodiment, the control system is further arranged and adapted to determine the location of the ions of interest in or from a survey scan.

In an embodiment, the survey scan comprises a multi-dimensional survey scan.

In an embodiment, the first physico-chemical property is either: (i) uncorrelated with mass to charge ratio; or (ii) at least partially correlated with mass to charge ratio.

In an embodiment, the first physico-chemical property comprises mass, mass to charge ratio or time of flight.

In an embodiment, the separation device comprises a time of flight separation device and/or an ion trap.

In an embodiment, the first physico-chemical property comprises ion mobility or differential ion mobility.

In an embodiment, the separation device comprises an ion mobility separator or a differential ion mobility separator.

In an embodiment, the control system is arranged and adapted to select multiple different ions of interest during the single cycle of separation.

In an embodiment, the control system is arranged and adapted in the first mode of operation to operate the first or analytical quadrupole rod set with a first mass to charge ratio transmission window such that at least some ions having mass to charge ratio values outside of the first mass to charge ratio transmission window are caused to impact upon the rods of the first or analytical quadrupole rod set.

In an embodiment, the apparatus further comprises an ion trap arranged upstream of the separation device.

In an embodiment, the ion trap is arranged and adapted to pulse one or more packets or ions into the separation device.

According to an aspect there is provided a method of filtering ions comprising:

separating ions temporally according to a first physico-chemical property using a separation device;

filtering the ions according to their mass to charge ratio using a first quadrupole rod set, wherein the first quadrupole rod set comprises a plurality of rods and wherein the first quadrupole rod set is arranged downstream of the separation device; and during a single cycle of separation of the separation device:

operating the first quadrupole rod set in a first substantially resolving mode of operation at separation times when ions of interest are expected to emerge from the separation device so that the ions of interest are selected by or filtered according to their mass to charge ratio by the first quadrupole rod set; and operating the first quadrupole rod set in a second substantially non-resolving or transmission mode of operation at separation times when substantially no ions of interest are expected to emerge from the separation device so that substantially no ions impact upon the rods of the first quadrupole rod set.

According to an aspect there is provided a method of filtering ions comprising:

separating ions temporally according to a first physico-chemical property using a separation device;

filtering the ions according to their mass to charge ratio using a filtering device, wherein the filtering device is arranged downstream of the separation device and wherein the filtering device comprises an analytical quadrupole rod set and a pre-filter quadrupole rod set arranged upstream of the analytical quadrupole rod set; and during a single cycle of separation of the separation device:

operating the filtering device in a first mode of operation wherein the pre-filter quadrupole rod set is operated in a transmissive mode of operation and wherein ions of interest are selected by the analytical quadrupole rod set; and operating the filtering device in a second mode of operation at separation times when substantially no ions of interest are present wherein the pre-filter quadrupole rod set is operated in a non-transmissive mode of operation so that substantially no ions impact upon the rods of the analytical quadrupole rod set.

According to an aspect there is provided an apparatus for filtering ions comprising:

a separation device for separating ions temporally according to a first physico-chemical property;

a filtering device for filtering the ions according to a second physico-chemical property, wherein the filtering device is arranged downstream of the separation device and wherein the filtering device comprises a first filter; and a control system arranged and adapted during a single cycle of separation of the separation device:

(i) to operate the filtering device in a first resolving mode of operation wherein ions of interest are selected by the first filter; and (ii) to operate the filtering device in a second non-resolving or transmission mode of operation at separation times when substantially no ions of interest are present so that substantially no ions are lost to the first filter.

In an embodiment, the first filter comprises a mass to charge ratio filter, an ion mobility filter, or a differential ion mobility filter.

According to an aspect there is provided a method of filtering ions comprising:

separating ions temporally according to a first physico-chemical property using a separation device;

filtering the ions according to a second physico-chemical property using a filtering device, wherein the filtering device comprises a first filter; and during a single cycle of separation of the separation device:

operating the filtering device in a first resolving mode of operation in which ions of interest are selected by the first filter; and operating the filtering device in a second non-resolving or transmission mode of operation at separation times when substantially no ions of interest are present so that substantially no ions are lost to the first filter.

In an embodiment, the first filter comprises a mass to charge ratio filter, an ion mobility filter, or a differential ion mobility filter.

According to an aspect there is provided a mass spectrometer comprising an apparatus for filtering ions as described above.

According to an aspect there is provided a method of mass spectrometry comprising a method of filtering ions as described above.

According to an aspect there is provided an apparatus for filtering ions comprising:

a separation device for separating ions temporally according to a first physico-chemical property;

a filtering device for filtering ions according to their mass to charge ratio downstream of the separation device, wherein the filtering device comprises a first quadrupole rod set; and a control system arranged and adapted during a single cycle of separation of the separation device:

to operate the filtering device in a first mode of operation in which ions of interest are selected by the first quadrupole rod set; and to operate the filtering device in a second mode of operation in which no ions impact upon the rods of the first quadrupole rod set.

In an embodiment, the control system is arranged and adapted:

to operate the filtering device in the first mode of operation when ions of interest are present; and to operate the filtering device in the second mode of operation when ions of interest are not present.

In an embodiment, the first physico-chemical property is either (i) uncorrelated with mass to charge ratio, or (ii) at least partially correlated with mass to charge ratio.

In an embodiment, the first physico-chemical property comprises mass, mass to charge ratio or time of flight.

In an embodiment, the separation device comprises a time of flight separation device and/or an ion trap.

In an embodiment, the first physico-chemical property comprises ion mobility or differential ion mobility.

In an embodiment, the separation device comprises an ion mobility separator or a differential ion mobility separator.

In an embodiment, the first quadrupole rod set comprises an analytical quadrupole rod set.

In an embodiment, the control system is arranged and adapted in the second mode of operation to operate the first quadrupole rod set in a non-resolving or transmission mode of operation.

In an embodiment, the filtering device comprises a first filter upstream of the first quadrupole rod set.

In an embodiment, the first filter comprises a second quadrupole rod set, a pre-filter quadrupole, a gate electrode, a deflector lens, a defocusing lens, and/or a Bradbury-Neilson gate.

In an embodiment, the control system is arranged and adapted in the second mode of operation to operate the first filter in a non-transmissive mode of operation.

In an embodiment, the control system is arranged and adapted in the first mode of operation to operate the first filter in a transmissive mode of operation.

In an embodiment, the control system is arranged and adapted in the first mode of operation to operate the first quadrupole rod set with a first mass to charge ratio transmission window, and to operate the first filter with a second mass to charge ratio transmission window, wherein the second mass to charge ratio transmission window is greater than or equal to and encompasses the first mass to charge ratio transmission window.

In an embodiment, the filtering device comprises a second filter downstream of the first quadrupole rod set.

In an embodiment, the second filter comprises a third quadrupole rod set and/or a post-filter quadrupole.

In an embodiment, the control system is arranged and adapted to select multiple different ions of interest during the single cycle of separation.

In an embodiment, the control system is arranged and adapted in the first mode of operation to operate the first quadrupole mass filter with a first mass to charge ratio transmission window such that at least some ions having mass to charge ratio values outside of the first mass to charge ratio transmission window are caused to impact upon the rods of the first quadrupole rod set.

In an embodiment, the apparatus further comprises an ion trap upstream of the separation device.

In an embodiment, the ion trap is arranged and adapted to pulse one or more packets or ions into the separation device.

According to an aspect there is provided a method of filtering ions comprising: separating ions temporally according to a first physico-chemical property using a separation device;

filtering the ions according to their mass to charge ratio using a filtering device, wherein the filtering device comprises a first quadrupole rod set; and during a single cycle of separation of the separation device:

operating the filtering device in a first mode of operation in which ions of interest are selected by the first quadrupole rod set; and operating the filtering device in a second mode of operation in which no ions impact upon the rods of the first quadrupole rod set.

According to an aspect there is provided an apparatus for filtering ions comprising:

a separation device for separating ions temporally according to a first physico-chemical property;

a filtering device for filtering ions according to a second physico-chemical property downstream of the separation device, wherein the filtering device comprises a first filter; and a control system arranged and adapted during a single cycle of separation of the separation device:

to operate the filtering device in a first mode of operation in which ions of interest are selected by the first filter; and to operate the filtering device in a second mode of operation in which no ions are lost to the first filter.

In an embodiment, the first filter comprises a mass to charge ratio filter, an ion mobility filter, or a differential ion mobility filter.

According to an aspect there is provided a method of filtering ions comprising:

separating ions temporally according to a first physico-chemical property using a separation device;

filtering the ions according to a second physico-chemical property using a filtering device, wherein the filtering device comprises a first filter; and during a single cycle of separation of the separation device:

operating the filtering device in a first mode of operation in which ions of interest are selected by the first filter; and operating the filtering device in a second mode of operation in which no ions are lost to the first filter.

In an embodiment, the first filter comprises a mass to charge ratio filter, an ion mobility filter, or a differential ion mobility filter.

According to an aspect there is provided a mass spectrometer comprising an apparatus for filtering ions as described above.

According to an aspect there is provided a method of mass spectrometry comprising a method of filtering ions as described above.

According to an aspect there is provided an apparatus for mass spectrometry comprising:

a separation device upstream of an analytical quadrupole;

wherein the pre-filter of the quadrupole device is arranged to switch between zero transmission and transmission of precursors of interest one or more times within the separation cycle.

In an embodiment, the separation device is mass to charge ratio, mass or ion mobility based.

According to an embodiment the mass spectrometer may further comprise:

(a) an ion source selected from the group consisting of: (i) an Electrospray ionisation ("ESI") ion source; (ii) an Atmospheric Pressure Photo Ionisation ("APPI") ion source; (iii) an Atmospheric Pressure Chemical Ionisation ("APCI") ion source; (iv) a Matrix Assisted Laser Desorption Ionisation ("MALDI") ion source; (v) a Laser Desorption Ionisation ("LDI") ion source; (vi) an Atmospheric Pressure Ionisation ("API") ion source; (vii) a Desorption Ionisation on Silicon ("DIOS") ion source; (viii) an Electron Impact ("EI") ion source; (ix) a Chemical Ionisation ("CI") ion source; (x) a Field Ionisation ("FI") ion source; (xi) a Field Desorption ("FD") ion source; (xii) an Inductively Coupled Plasma ("ICP") ion source; (xiii) a Fast Atom Bombardment ("FAB") ion source; (xiv) a Liquid Secondary Ion Mass Spectrometry ("LSIMS") ion source; (xv) a Desorption Electrospray Ionisation ("DESI") ion source; (xvi) a Nickel-63 radioactive ion source; (xvii) an Atmospheric Pressure Matrix Assisted Laser Desorption Ionisation ion source; (xviii) a Thermospray ion source; (xix) an Atmospheric Sampling Glow Discharge Ionisation ("ASGDI") ion source; (xx) a Glow Discharge ("GD") ion source; (xxi) an Impactor ion source; (xxii) a Direct Analysis in Real Time ("DART") ion source; (xxiii) a Laserspray Ionisation ("LSI") ion source; (xxiv) a Sonicspray Ionisation ("SSI") ion source; (xxv) a Matrix Assisted Inlet Ionisation ("MAII") ion source; (xxvi) a Solvent Assisted Inlet Ionisation ("SAII") ion source; (xxvii) a Desorption Electrospray Ionisation ("DESI") ion source; and (xxviii) a Laser Ablation Electrospray Ionisation ("LAESI") ion source; and/or (b) one or more continuous or pulsed ion sources; and/or (c) one or more ion guides; and/or (d) one or more ion mobility separation devices and/or one or more Field Asymmetric Ion Mobility Spectrometer devices; and/or (e) one or more ion traps or one or more ion trapping regions; and/or (f) one or more collision, fragmentation or reaction cells selected from the group consisting of: (i) a Collisional Induced Dissociation ("CID") fragmentation device; (ii) a Surface Induced Dissociation ("SID") fragmentation device; (iii) an Electron Transfer Dissociation ("ETD") fragmentation device; (iv) an Electron Capture Dissociation ("ECD") fragmentation device; (v) an Electron Collision or Impact Dissociation fragmentation device; (vi) a Photo Induced Dissociation ("PID") fragmentation device; (vii) a Laser Induced Dissociation fragmentation device; (viii) an infrared radiation induced dissociation device; (ix) an ultraviolet radiation induced dissociation device; (x) a nozzle-skimmer interface fragmentation device; (xi) an in-source fragmentation device; (xii) an in-source Collision Induced Dissociation fragmentation device; (xiii) a thermal or temperature source fragmentation device; (xiv) an electric field induced fragmentation device; (xv) a magnetic field induced fragmentation device; (xvi) an enzyme digestion or enzyme degradation fragmentation device; (xvii) an ion-ion reaction fragmentation device; (xviii) an ion-molecule reaction fragmentation device; (xix) an ion-atom reaction fragmentation device; (xx) an ion-metastable ion reaction fragmentation device; (xxi) an ion-metastable molecule reaction fragmentation device; (xxii) an ion-metastable atom reaction fragmentation device; (xxiii) an ion-ion reaction device for reacting ions to form adduct or product ions; (xxiv) an ion-molecule reaction device for reacting ions to form adduct or product ions; (xxv) an ion-atom reaction device for reacting ions to form adduct or product ions; (xxvi) an ion-metastable ion reaction device for reacting ions to form adduct or product ions; (xxvii) an ion-metastable molecule reaction device for reacting ions to form adduct or product ions; (xxviii) an ion-metastable atom reaction device for reacting ions to form adduct or product ions; and (xxix) an Electron Ionisation Dissociation ("EID") fragmentation device; and/or (g) a mass analyser selected from the group consisting of: (i) a quadrupole mass analyser; (ii) a 2D or linear quadrupole mass analyser; (iii) a Paul or 3D quadrupole mass analyser; (iv) a Penning trap mass analyser; (v) an ion trap mass analyser; (vi) a magnetic sector mass analyser; (vii) Ion Cyclotron Resonance ("ICR") mass analyser; (viii) a Fourier Transform Ion Cyclotron Resonance ("FTICR") mass analyser; (ix) an electrostatic mass analyser arranged to generate an electrostatic field having a quadro-logarithmic potential distribution; (x) a Fourier Transform electrostatic mass analyser; (xi) a Fourier Transform mass analyser; (xii) a Time of Flight mass analyser; (xiii) an orthogonal acceleration Time of Flight mass analyser; and (xiv) a linear acceleration Time of Flight mass analyser; and/or (h) one or more energy analysers or electrostatic energy analysers; and/or (i) one or more ion detectors; and/or (j) one or more mass filters selected from the group consisting of: (i) a quadrupole mass filter; (ii) a 2D or linear quadrupole ion trap; (iii) a Paul or 3D quadrupole ion trap; (iv) a Penning ion trap; (v) an ion trap; (vi) a magnetic sector mass filter; (vii) a Time of Flight mass filter; and (viii) a Wien filter; and/or (k) a device or ion gate for pulsing ions; and/or (l) a device for converting a substantially continuous ion beam into a pulsed ion beam.

The mass spectrometer may further comprise either:

(i) a C-trap and a mass analyser comprising an outer barrel-like electrode and a coaxial inner spindle-like electrode that form an electrostatic field with a quadro-logarithmic potential distribution, wherein in a first mode of operation ions are transmitted to the C-trap and are then injected into the mass analyser and wherein in a second mode of operation ions are transmitted to the C-trap and then to a collision cell or Electron Transfer Dissociation device wherein at least some ions are fragmented into fragment ions, and wherein the fragment ions are then transmitted to the C-trap before being injected into the mass analyser; and/or (ii) a stacked ring ion guide comprising a plurality of electrodes each having an aperture through which ions are transmitted in use and wherein the spacing of the electrodes increases along the length of the ion path, and wherein the apertures in the electrodes in an upstream section of the ion guide have a first diameter and wherein the apertures in the electrodes in a downstream section of the ion guide have a second diameter which is smaller than the first diameter, and wherein opposite phases of an AC or RF voltage are applied, in use, to successive electrodes.

According to an embodiment the mass spectrometer further comprises a device arranged and adapted to supply an AC or RF voltage to the electrodes. The AC or RF voltage optionally has an amplitude selected from the group consisting of: (i) about <50 V peak to peak; (ii) about 50-100 V peak to peak; (iii) about 100-150 V peak to peak; (iv) about 150-200 V peak to peak; (v) about 200-250 V peak to peak; (vi) about 250-300 V peak to peak; (vii) about 300-350 V peak to peak; (viii) about 350-400 V peak to peak; (ix) about 400-450 V peak to peak; (x) about 450-500 V peak to peak; and (xi) >about 500 V peak to peak.

The AC or RF voltage may have a frequency selected from the group consisting of: (i) <about 100 kHz; (ii) about 100-200 kHz; (iii) about 200-300 kHz; (iv) about 300-400 kHz; (v) about 400-500 kHz; (vi) about 0.5-1.0 MHz; (vii) about 1.0-1.5 MHz; (viii) about 1.5-2.0 MHz; (ix) about 2.0-2.5 MHz; (x) about 2.5-3.0 MHz; (xi) about 3.0-3.5 MHz; (xii) about 3.5-4.0 MHz; (xiii) about 4.0-4.5 MHz; (xiv) about 4.5-5.0 MHz; (xv) about 5.0-5.5 MHz; (xvi) about 5.5-6.0 MHz; (xvii) about 6.0-6.5 MHz; (xviii) about 6.5-7.0 MHz; (xix) about 7.0-7.5 MHz; (xx) about 7.5-8.0 MHz; (xxi) about 8.0-8.5 MHz; (xxii) about 8.5-9.0 MHz; (xxiii) about 9.0-9.5 MHz; (xxiv) about 9.5-10.0 MHz; and (xxv) >about 10.0 MHz.

The mass spectrometer may also comprise a chromatography or other separation device upstream of an ion source. According to an embodiment the chromatography separation device comprises a liquid chromatography or gas chromatography device. According to another embodiment the separation device may comprise: (i) a Capillary Electrophoresis ("CE") separation device; (ii) a Capillary Electrochromatography ("CEC") separation device; (iii) a substantially rigid ceramic-based multilayer microfluidic substrate ("ceramic tile") separation device; or (iv) a supercritical fluid chromatography separation device.

The ion guide may be maintained at a pressure selected from the group consisting of: (i) <about 0.0001 mbar; (ii) about 0.0001-0.001 mbar; (iii) about 0.001-0.01 mbar; (iv) about 0.01-0.1 mbar; (v) about 0.1-1 mbar; (vi) about 1-10 mbar; (vii) about 10-100 mbar; (viii) about 100-1000 mbar; and (ix) >about 1000 mbar.

According to an embodiment analyte ions may be subjected to Electron Transfer Dissociation ("ETD") fragmentation in an Electron Transfer Dissociation fragmentation device. Analyte ions may be caused to interact with ETD reagent ions within an ion guide or fragmentation device.

According to an embodiment in order to effect Electron Transfer Dissociation either: (a) analyte ions are fragmented or are induced to dissociate and form product or fragment ions upon interacting with reagent ions; and/or (b) electrons are transferred from one or more reagent anions or negatively charged ions to one or more multiply charged analyte cations or positively charged ions whereupon at least some of the multiply charged analyte cations or positively charged ions are induced to dissociate and form product or fragment ions; and/or (c) analyte ions are fragmented or are induced to dissociate and form product or fragment ions upon interacting with neutral reagent gas molecules or atoms or a non-ionic reagent gas; and/or (d) electrons are transferred from one or more neutral, non-ionic or uncharged basic gases or vapours to one or more multiply charged analyte cations or positively charged ions whereupon at least some of the multiply charged analyte cations or positively charged ions are induced to dissociate and form product or fragment ions; and/or (e) electrons are transferred from one or more neutral, non-ionic or uncharged superbase reagent gases or vapours to one or more multiply charged analyte cations or positively charged ions whereupon at least some of the multiply charge analyte cations or positively charged ions are induced to dissociate and form product or fragment ions; and/or (f) electrons are transferred from one or more neutral, non-ionic or uncharged alkali metal gases or vapours to one or more multiply charged analyte cations or positively charged ions whereupon at least some of the multiply charged analyte cations or positively charged ions are induced to dissociate and form product or fragment ions; and/or (g) electrons are transferred from one or more neutral, non-ionic or uncharged gases, vapours or atoms to one or more multiply charged analyte cations or positively charged ions whereupon at least some of the multiply charged analyte cations or positively charged ions are induced to dissociate and form product or fragment ions, wherein the one or more neutral, non-ionic or uncharged gases, vapours or atoms are selected from the group consisting of: (i) sodium vapour or atoms; (ii) lithium vapour or atoms; (iii) potassium vapour or atoms; (iv) rubidium vapour or atoms; (v) caesium vapour or atoms; (vi) francium vapour or atoms; (vii) $C_{60}$ vapour or atoms; and (viii) magnesium vapour or atoms.

The multiply charged analyte cations or positively charged ions may comprise peptides, polypeptides, proteins or biomolecules.

According to an embodiment in order to effect Electron Transfer Dissociation: (a) the reagent anions or negatively charged ions are derived from a polyaromatic hydrocarbon or a substituted polyaromatic hydrocarbon; and/or (b) the reagent anions or negatively charged ions are derived from the group consisting of: (i) anthracene; (ii) 9,10 diphenylanthracene; (iii) naphthalene; (iv) fluorine; (v) phenanthrene; (vi) pyrene; (vii) fluoranthene; (viii) chrysene; (ix) triphenylene; (x) perylene; (xi) acridine; (xii) 2,2' dipyridyl; (xiii) 2,2' biquinoline; (xiv) 9-anthracenecarbonitrile; (xv) dibenzothiophene; (xvi) 1,10'-phenanthroline; (xvii) 9' anthracenecarbonitrile; and (xviii) anthraquinone; and/or (c) the reagent ions or negatively charged ions comprise azobenzene anions or azobenzene radical anions.

According to an embodiment the process of Electron Transfer Dissociation fragmentation comprises interacting analyte ions with reagent ions, wherein the reagent ions comprise dicyanobenzene, 4-nitrotoluene or azulene.

BRIEF DESCRIPTION OF THE DRAWINGS

Various embodiments will now be described, by way of example only, and with reference to the accompanying drawings in which.

DETAILED DESCRIPTION

An embodiment will now be described and relates to a method of operating a quadrupole based mass spectrometer whereby the ion population undergoes a temporal separation prior to arriving at a quadrupole apparatus or filtering device.

A pulsed temporal separation device may be coupled to a temporal gating device. Ions may be pulsed into the separation device whereupon the ions are caused to separate according to a first physico-chemical property. The first physico-chemical property may comprise mass to charge ratio or may comprise a physico-chemical property which is related to or correlated with mass to charge ratio (e.g. ion mobility).

The separation device may separate multiple parent or precursor ions prior to their arrival at the downstream quadrupole apparatus or filtering device. The downstream quadrupole apparatus or filtering device may comprise a resolving analytical quadrupole.

The quadrupole apparatus downstream of the separation device may be switched between at least two modes of operation during the separation cycle i.e. as a function of separation time.

In a first mode of operation, the resolving analytical quadrupole may be operated in a resolving mode so as to isolate ions of interest. The first mode may comprise a mode wherein the resolving analytical quadrupole operates in a mass to charge ratio filtering mode such that at least some ions outside of the mass to charge ratio range of interest are lost to the quadrupole rods. This mode of operation may be enabled at times where ions of interest (e.g. precursor or parent ions of interest) are present.

In a second mode of operation the quadrupole apparatus may be arranged so that substantially no ions are lost to the analytical quadrupole rods. This mode of operation may be enabled at times when no ions of interest (e.g. parent or precursor ions of interest) are present at the quadrupole.

Figure 2A:
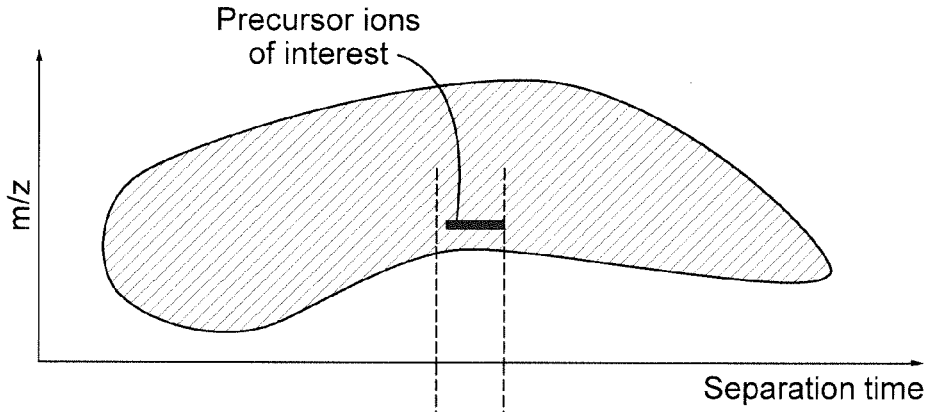
FIG. 2A shows schematically an ion population obtained by separating ions temporally according to a physico-chemical property that is uncorrelated with mass to charge ratio (m/z) and FIG. 2B shows schematically the operation of the filtering device in accordance with an embodiment.
Figure 2B:
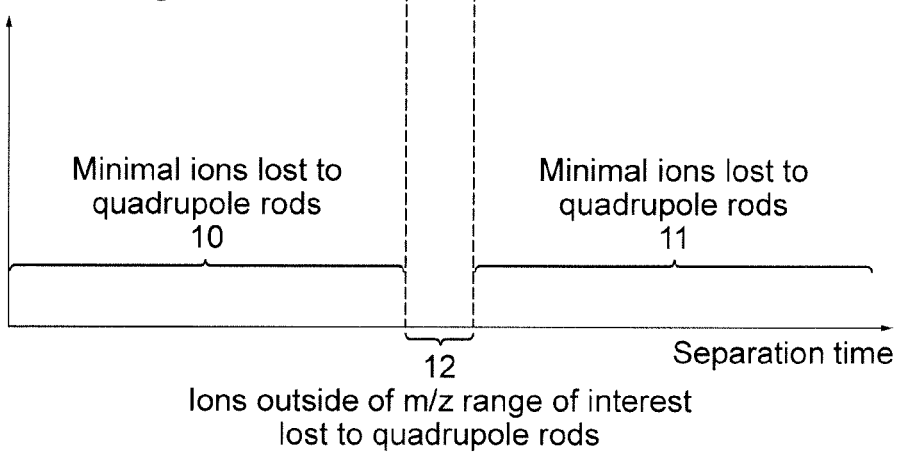

FIGS. 2A and 2B illustrate the operation of a first embodiment. In this embodiment, the first physico-chemical property is uncorrelated with mass to charge ratio (i.e. the separation device separates ions temporally according to a physico-chemical property that is uncorrelated with mass to charge ratio). The grey region in FIG. 2A represents an ion population that has been separated temporally by the separation device. The black line represents ions of interest present in the ion population.

As shown in FIG. 2B, according to an embodiment, at separation times when ions of interest are present (i.e. at time 12), the filtering device is operated such that the analytical quadrupole selects (i.e. filters and onwardly transmits) the ions of interest. However, at separation times when no ions of interest are present (i.e. at times 10 and 11) the filtering device is operated so that no ions are lost to the rods of the analytical quadrupole.

This embodiment may comprise a step of determining where the ions of interest are located in an ion population (i.e. where the ions of interest are located in the two-dimensional mass to charge ratio-separation time space). This may be done, for example, based on knowledge of the sample e.g. gained from earlier experiments such as an earlier multi-dimensional survey scan. This is necessary because the ions of interest (having the mass to charge ratio value of interest) can in principle elute from the separation device over a wide range of times (because in this embodiment the separation time is not correlated with mass to charge ratio).

Figure 3A:
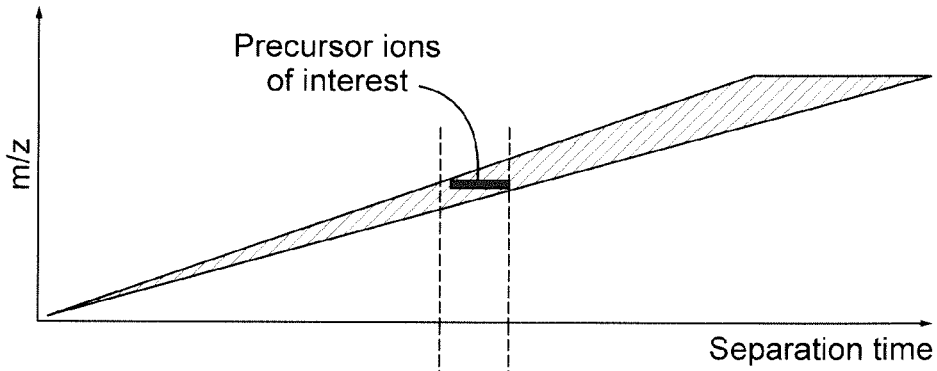
FIG. 3A shows schematically an ion population obtained by separating ions temporally according to a physico-chemical property that is correlated with mass to charge ratio (m/z) and FIG. 3B shows schematically the operation of the filtering device in accordance with an embodiment.
Figure 3B:
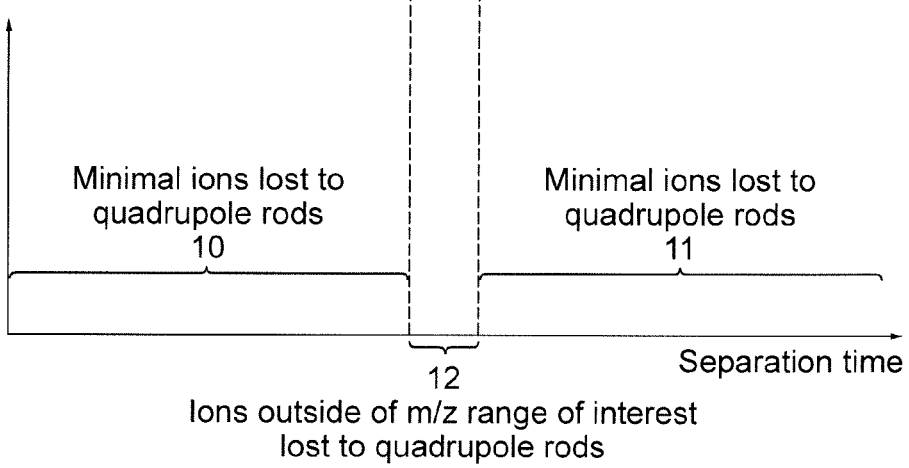

FIGS. 3A and 3B illustrate the operation according to another embodiment. In this embodiment, the first physico-chemical property is correlated with mass to charge ratio (i.e. the separation device separates ions temporally according to a physico-chemical property that is correlated with mass to charge ratio). The first physico-chemical property may comprise, for example, mass to charge ratio or ion mobility. As in FIGS. 2A and 2B, the grey region in FIG. 3A represents an ion population that has been separated temporally by the separation device. The black line represents ions of interest present in the ion population.

According to this embodiment the relationship between separation time and mass to charge ratio means that the time at which the quadrupole should be switched between the two modes of operation can be determined accurately from the mass to charge ratio value of the ions of interest alone.

Furthermore, the relationship between time and mass to charge ratio restricts the mass to charge ratio range of ions present at the quadrupole when it is switched into resolving mode (i.e. during time period 12) thereby further reducing the number of ions lost to the quadrupole. This can be seen by comparing FIG. 3A with FIG. 2A. In FIG. 3A, a relatively narrow range of ions are present at separation time 12 when the ions of interest are present. In contrast, in FIG. 2A, the uncorrelated nature of the separation time with mass to charge ratio results in a wide mass to charge ratio range of ions eluting from the separation device at the time 12 of interest. This increases the number of ions lost to the rods of the analytical quadrupole when the quadrupole is operated in a resolving mode.

Figure 1:
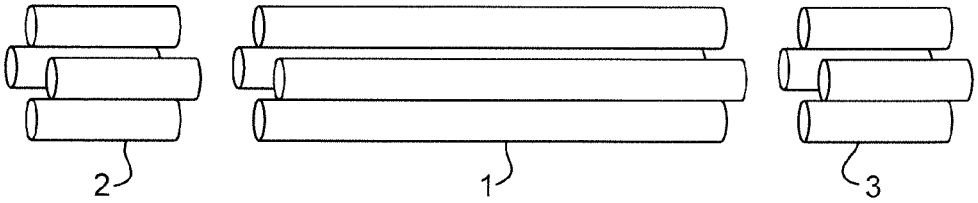
FIG. 1 shows schematically a quadrupole rod set mass filter arrangement that may be operated in accordance with an embodiment.

Embodiments may be implemented with a typical quadrupole geometry as shown in FIG. 1. An analytical quadrupole rod set 1 may be preceded by a pre-filter quadrupole rod set 2 and followed by a post-filter quadrupole rod set 3. Whilst FIG. 1 shows a quadrupole assembly including both a pre-filter 2 and a post-filter 3, it will be appreciated that the device can work without a post-filter 3. Advantageously, this approach does not require the provision of hardware in addition to a typical quadrupole mass filter arrangement.

Figure 4:
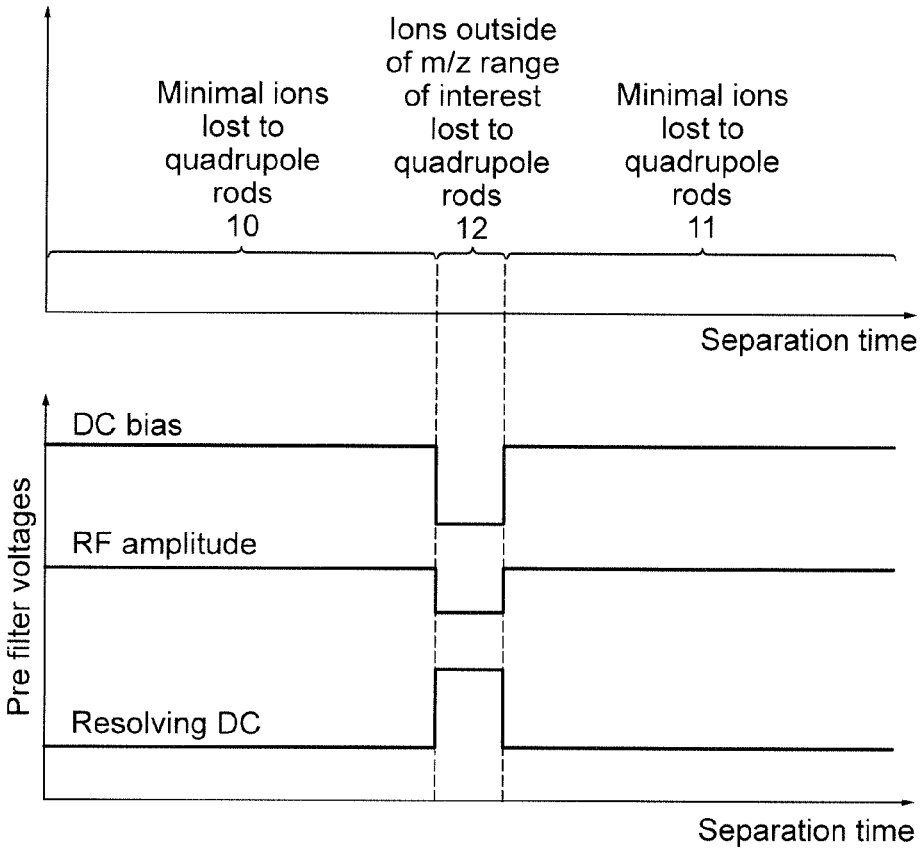
FIG. 4 shows schematically the operation of a pre-filter quadrupole of a quadrupole mass filter arrangement in accordance with an embodiment.

FIG. 4 illustrates one method of operating the device of FIG. 1. It will be appreciated that in FIG. 4, the illustrated voltage waveforms are not quantitative and are merely intended to represent the direction of change (e.g. for positive ions) when switching between modes.

In the first mode of operation (during time period 12) both an RF voltage and a resolving DC voltage are applied to the pre-filter 2 such that ions within a mass to charge ratio range greater than or equal to and encompassing the mass to charge ratio range of ions of interest are onwardly transmitted by the pre-filter 2. In an embodiment, in the first mode of operation the level of resolving DC may be equal or close to zero, allowing stable trajectories of ions of interest along the entire ion path.

In the second mode of operation (during time periods 10 and 11), an RF voltage and a resolving DC voltage are applied to the pre-filter 2 such that all ions within the pre-filter 2 are unstable, and no ions are onwardly transmitted to the analytical quadrupole 1.

With regard to the arrangement shown in FIG. 4, the DC bias of the pre-filter 2 is also switched at times 12 when ions of interest are present, to ensure unwanted ions are slowed down and have enough time to be ejected whilst desired ions experience optimised transfer conditions. In one embodiment this switch in DC bias is not used.

In the embodiment described above with reference to FIGS. 1 and 4, the transmission characteristics of the analytical quadrupole 1 and a post-filter 3 (if present) may remain static for the entire separation time, or may switch in synchronisation with the pre-filter 2.

In some embodiments, multiple ions of interest (e.g. parent or precursor ions of interest) may elute from the separation device and be sequentially selected by the resolving quadrupole. In these embodiments, the analytical quadrupole 1 may be switched synchronously with the pre-filter 2. Accordingly, in an embodiment, one or more ions (e.g. parent or precursor ions) of interest are selected per separation cycle.

In various embodiments, the analytical quadrupole 1 can be preceded by a range of known ions sources and/or ion guides and/or followed by a range of known analytical devices including fragmentation devices and/or mass spectrometers.

Thus, according to an embodiment, there is provided an apparatus for mass spectrometry comprising a separation device arranged upstream of an analytical quadrupole, wherein the pre-filter of the quadrupole device is arranged to switch between zero transmission and transmission of ions (e.g. parent or precursor ions) of interest one or more times within the separation cycle. The separation device may be mass to charge ratio, mass or ion mobility based.

Figure 5A:
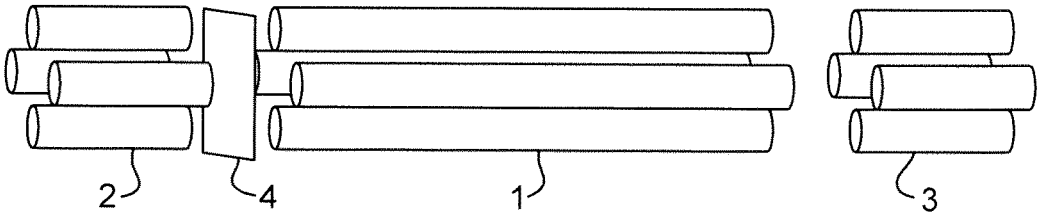
FIG. 5A shows schematically a quadrupole rod set mass filter arrangement comprising an ion gate that may be operated in accordance with an embodiment and FIG. 5B shows schematically the operation of the ion gate in accordance with an embodiment.

In various other embodiments, gating electrodes may be used upstream of the analytical quadrupole 1 in place of or in addition to the pre-filter quadrupole 2. Gating electrodes such as those used in deflector lenses or defocusing lenses may be used, or a Bradbury-Neilson (B-N) gate may be used. These embodiments require additional hardware relative to other embodiments which use the pre-filter quadrupole 2 of a quadrupole mass filter arrangement FIG. 5A shows an embodiment in which a Bradbury-Neilson gate 4 is provided and used as the first filter. The Bradbury-Neilson gate 4 may be operated to switch between maximum transmission and zero transmission at the appropriate times. This prevents ions being lost to the analytical quadrupole 1 rods by preventing the ions reaching the quadrupole assembly. In the arrangement shown in FIG. 5A the Bradbury-Neilson gate 4 is shown disposed between the pre-filter 2 and the analytical quadrupole 1. However, the Bradbury-Neilson gate 4 may be placed anywhere between the upstream separation device and the analytical quadrupole 1.

Figure 5B:
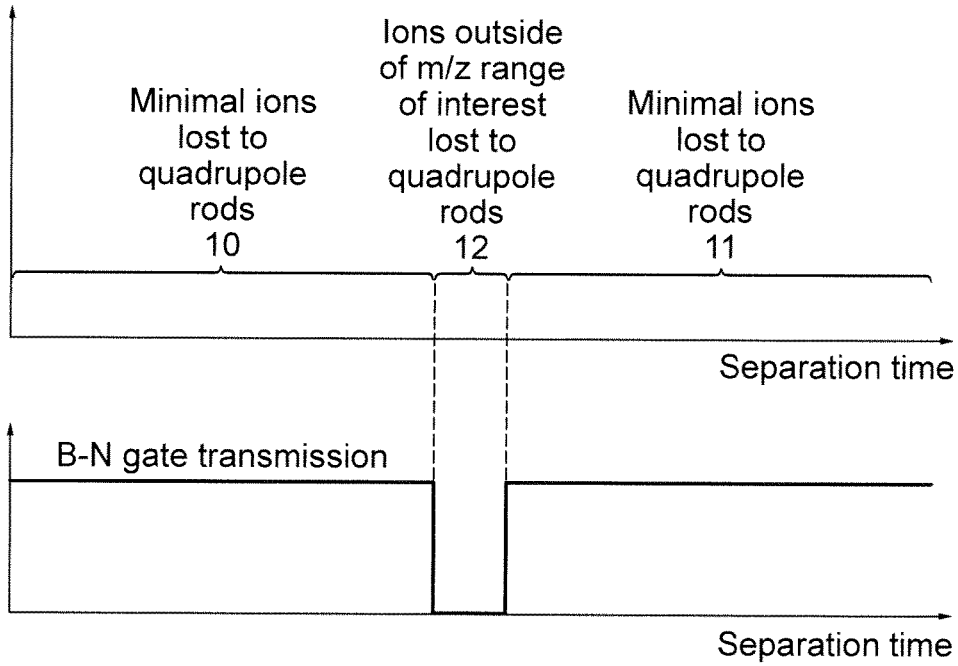

FIG. 5B shows the transmission of the Bradbury-Neilson gate 4 according to an embodiment.

Other embodiments are contemplated which include providing and using one or more downstream devices such as one or more post-filters 3 or gates.

In an embodiment, synchronised data acquisition may be performed in combination with switching the analytical quadrupole 1 between resolving and non-resolving modes.

In various embodiments, other mass spectrometers or filters may be provided and used, including time of flight instruments, electrostatic traps, and/or mass analysers employing inductive detection. In an embodiment, time domain signal processing that converts time domain signals to mass to charge ratio domain signals or spectra is used. In various embodiments, the processing includes (but is not limited to) Fourier Transform, probabilistic analysis, filter diagonalisation, forward fitting and least squares fitting.

In various embodiments, the above disclosed approach may be applied to none mass based filters including Differential Mobility Separation (DMS), Field Asymmetric Ion Mobility Spectrometry (FAIMS) and/or Differential Mobility Analysis (DMA) filters. These embodiments comprise separating ions temporally according to a first physico-chemical, filtering the ions according to a second physico-chemical property, and during a single cycle of separation of said separation device: (i) operating the filtering device in a first mode of operation in which ions of interest are selected by the filter; and (ii) operating the filtering device in a second mode of operation in which no ions are lost to the first filter.

In various embodiments, tandem mass spectrometers and/or ion mobility spectrometry enabled instruments may make use of the approach of as disclosed above.

It will be appreciated that an embodiment provided an apparatus for filtering ions, wherein the robustness and lifetime of the resolving quadrupole is improved.

Although the present invention has been described with reference to preferred embodiments, it will be understood by those skilled in the art that various changes in form and detail may be made without departing from the scope of the invention as set forth in the accompanying claims.

The invention claimed is:

1. An apparatus for filtering ions comprising:

a separation device for separating ions temporally according to a first physico-chemical property;

a filtering device for filtering ions according to their mass to charge ratio, wherein said filtering device is arranged downstream of said separation device and wherein said filtering device comprises an analytical quadrupole rod set and a pre-filter quadrupole rod set arranged upstream of said analytical quadrupole rod set; and a control system arranged and adapted during a single cycle of separation of said separation device:

(i) to operate said filtering device in a first mode of operation wherein said pre-filter quadrupole rod set is operated in a transmissive mode of operation and wherein ions of interest are selected by said analytical quadrupole rod set; and (ii) to operate said filtering device in a second mode of operation at separation times when substantially no ions of interest are present wherein said pre-filter quadrupole rod set is operated in a non-transmissive mode of operation so that substantially no ions impact upon the rods of said analytical quadrupole rod set.

2. An apparatus as claimed in claim 1, wherein said control system is arranged and adapted in said first mode of operation to operate said analytical quadrupole rod set with a first mass to charge ratio transmission window, and to operate said pre-filter quadrupole rod set with a second mass to charge ratio transmission window, wherein said second mass to charge ratio transmission window is greater than or equal to and encompasses said first mass to charge ratio transmission window.

3. An apparatus as claimed in claim 1 wherein said filtering device comprises a post-filter quadrupole rod set arranged downstream of said analytical quadrupole rod set.

4. An apparatus for filtering ions comprising:

a separation device for separating ions temporally according to a first physico-chemical property;

a first quadrupole rod set for filtering said ions according to their mass to charge ratio, wherein said first quadrupole rod set comprises a plurality of rods and wherein said first quadrupole rod set is arranged downstream of said separation device; and a control system arranged and adapted during a single cycle of separation of said separation device:

(i) to operate said first quadrupole rod set in a first substantially resolving mode of operation at separation times when ions of interest are expected to emerge from said separation device so that said ions of interest are selected by or filtered according to their mass to charge ratio by said first quadrupole rod set; and (ii) to operate said first quadrupole rod set in a second substantially non-resolving or transmission mode of operation at separation times when substantially no ions of interest are expected to emerge from said separation device so that substantially no ions impact upon said rods of said first quadrupole rod set.

5. An apparatus as claimed in claim 4, wherein said control system is further arranged and adapted to determine the location of said ions of interest in or from a survey scan.

6. Apparatus as claimed in claim 5, wherein said survey scan comprises a multi-dimensional survey scan.

7. An apparatus as claimed in claim 4, wherein said first physico-chemical property is either: (i) uncorrelated with mass to charge ratio; or (ii) at least partially correlated with mass to charge ratio.

8. An apparatus as claimed in claim 4, wherein said first physico-chemical property comprises mass, mass to charge ratio or time of flight.

9. An apparatus as claimed in claim 8, wherein said separation device comprises a time of flight separation device and/or an ion trap.

10. An apparatus as claimed in claim 4, wherein said first physico-chemical property comprises ion mobility or differential ion mobility.

11. An apparatus as claimed in claim 10, wherein said separation device comprises an ion mobility separator or a differential ion mobility separator.

12. An apparatus as claimed in claim 4, wherein said control system is arranged and adapted to select multiple different ions of interest during said single cycle of separation.

13. An apparatus as claimed in claim 4, wherein said control system is arranged and adapted in said first mode of operation to operate said first or analytical quadrupole rod set with a first mass to charge ratio transmission window such that at least some ions having mass to charge ratio values outside of said first mass to charge ratio transmission window are caused to impact upon said rods of said first or analytical quadrupole rod set.

14. An apparatus as claimed in claim 4, further comprising an ion trap arranged upstream of said separation device.

15. An apparatus as claimed in claim 14, wherein said ion trap is arranged and adapted to pulse one or more packets or ions into said separation device.

16. A method of filtering ions comprising:

separating ions temporally according to a first physico-chemical property using a separation device;

filtering said ions according to their mass to charge ratio using a first quadrupole rod set, wherein said first quadrupole rod set comprises a plurality of rods and wherein said first quadrupole rod set is arranged downstream of said separation device; and during a single cycle of separation of said separation device:

operating said first quadrupole rod set in a first substantially resolving mode of operation at separation times when ions of interest are expected to emerge from said separation device so that said ions of interest are selected by or filtered according to their mass to charge ratio by said first quadrupole rod set; and operating said first quadrupole rod set in a second substantially non-resolving or transmission mode of operation at separation times when substantially no ions of interest are expected to emerge from said separation device so that substantially no ions impact upon said rods of said first quadrupole rod set.

17. A method of mass spectrometry comprising a method of filtering ions as claimed in claim 16.

18. A mass spectrometer comprising an apparatus for filtering ions as claimed in claim 4.

* * * * *